US005996326A

United States Patent [19]

Braxmeier

[11] Patent Number: 5,996,326

[45] Date of Patent: Dec. 7, 1999

[54] SPINDLE FOR A SPINNING OR A TWISTING MACHINE

[75] Inventor: Hans Braxmeier, Suessen, Germany

[73] Assignee: Novibra GmbH, Suessen, Germany

[21] Appl. No.: 09/089,383

[22] Filed: Jun. 3, 1998

[30] Foreign Application Priority Data

Jun. 20, 1997 [DE] Germany ..... 197 26 216

[51] Int. Cl.[6] ..... D01H 7/08

[52] U.S. Cl. ..... 57/135; 57/133; 57/134; 384/231; 384/234

[58] Field of Search ..... 57/135, 133, 134; 384/227, 230, 231, 234

[56] References Cited

U.S. PATENT DOCUMENTS

| | | | |
|---|---|---|---|
| 3,065,593 | 11/1962 | Westall et al. | 57/135 |
| 3,920,291 | 11/1975 | Wendel et al. | 57/135 X |
| 5,359,842 | 11/1994 | Braxmeier et al. | 57/135 X |
| 5,528,892 | 6/1996 | Pesek et al. | 57/135 |
| 5,802,827 | 9/1998 | Stahlecker | 57/135 |

FOREIGN PATENT DOCUMENTS

| | | | |
|---|---|---|---|
| 522 689 | 8/1974 | Switzerland . | |
| 845669 | 8/1960 | United Kingdom | 57/135 |
| 976444 | 11/1964 | United Kingdom | 57/135 |
| 977278 | 12/1964 | United Kingdom . | |

*Primary Examiner*—William Stryjewski
*Attorney, Agent, or Firm*—Evenson McKeown Edwards & Lenahan, PLLC

[57] ABSTRACT

A spindle for a spinning or twisting machine includes a step bearing sleeve which is supported in a damping tube. The damping tube is arranged, with clearance from an oil filled damping gap, free floating and radially movable in a bearing housing. The damping gap has preferably a gap width of 0.2 mm to 0.4 mm. The damping tube is provided with radial bore holes, which connect the damping gap with the area of the step bearing sleeve. In spite of even the smallest radial movements of the damping tube, a hydraulic damping as well as a hydraulic centering is possible.

32 Claims, 3 Drawing Sheets

301
302
303
305
317
315
316
311
s
308
310
306
313
318
323
304
L
307
312
309
319
322
321
320
D

SPINDLE FOR A SPINNING OR A TWISTING MACHINE

BACKGROUND AND SUMMARY OF THE INVENTION

This application claims the priority of German application 197 26 216.3, filed in Germany on Jun. 20, 1997, the disclosure of which is expressly incorporated by reference herein.

The present invention relates to a spindle for spinning or twisting machines comprising a step bearing sleeve as well as a damping tube which takes up said step bearing sleeve, which damping tube is arranged radially movable in a bearing housing with clearance to an oil filled damping gap.

In the case of a spindle of this type (Swiss patent 552 689), the damping tube is a bearing tube fixed in a bearing housing, which bearing tube comprises a flectional area and a damping area. Due to its resilience in the flectional area, the bearing tube makes oscillations in the damping area, which are hydraulically dampened. The readjusting forces for centering the step bearing sleeve are primarily generated by the lateral forces. In order that the radial movements necessary for an effective damping action are possible, the bearing tube must have sufficient clearance in the damping area.

In the case of another spindle of the above mentioned type (British patent 977 278), the damping tube is arranged so that it oscillates with the aid of a tension spring in the bearing housing. Thus in this case a purely mechanical centering of the step bearing sleeve also takes place. In order to achieve a hydraulic damping, radial oscillations are again necessary, which require a sufficiently wide damping gap.

Large damping gaps, present in both cases of the known spindles, lead inevitably to relatively large oscillations of the spindle shaft and thus to an unsteady operation of the spindle. In the case of both known spindles, the damping tube is fixed at a point in the bearing housing, so that the centering forces are generated by means of this fixing point.

It is an object of the present invention to reduce overall the radial movements of the damping tube and thus those of the spindle so that the spindle operates more steadily, and to permit, in addition to the hydraulic damping, a purely hydraulic centering.

This object has been achieved in accordance with the present invention in that the damping tube is arranged free floating in the bearing housing.

Due to the damping tube being floatingly arranged, it has no direct contact with the bearing housing. A torsion lock may be present which prevents a gradual rotation of the damping tube in the bearing housing in certain preferred embodiments. Under no circumstances should any lateral forces be transmitted into the damping tube by means of any torsion lock which may be present. Thus a purely hydraulic centering also takes place in spite of very slight radial movements in addition to a purely hydraulic damping. A so-called gap damping and gap centering occurs for the spindle, whereby a hydrodynamic over-pressure occurs in the oil between the damping tube and the bearing housing as a result of the rotating load in the damping gap. The damping tube is raised from the metal surface of the bearing housing and is supported by the oil film.

The oil pressure in the damping gap depends on the gap width as well as length and the average diameter, and, to a certain degree, on the speed with which the circumferential load moves along the damping gap in circumferential direction. For this reason it is advantageous when the damping tube has the largest possible diameter. Not only is the length of the damping gap enlarged in circumferential direction but also the circumferential speed of the occurring circumferential load is accordingly increased. The gap width can then be made wider.

When in operation, a balance exists between the hydrodynamic oil pressure in the damping gap and the dynamic and static forces, generated by the spindle upper part, acting on the bearing. The damping gap is most effective the further away it is from the neck bearing. For this reason, the damping tube is extended so that it is still arranged underneath the step bearing sleeve.

In order to permit an effective hydraulic damping as well as a hydraulic centering, the damping tube should be as light as possible. It is thus provided that the damping tube is preferably made of plastic or a light metal.

Due to the constant imbalances of the upper spindle part, the step bearing sleeve and thus also the damping tube carry out wobbling type movements, which correspond to the spindle speed. In the case of high spindle rotations, it can happen that gas bubbles form in the circumferential gap narrowing due to the oscillations of the damping tube, and because of the rotating vacuum occurring in the damping gap, the oil starts to evaporate. It is important therefore to ensure that at such points, oil is sufficiently quickly supplied so that the hydraulic centering does not fail. For this reason, in a further embodiment of the invention, the damping tube is provided with radial bore holes which connect the damping gap with the area of the step bearing sleeve. This arrangement, however, requires that the step bearing is lubricated with the same oil as that which is in the damping gap.

For the purposes of the invention, two or four radial bore holes are distributed uniformly in circumferential direction of the damping tube. Additionally the damping gap may extend to form oil pockets in the area of the radial bore holes, in order to permit a particularly quick supply of oil to the critical points. In the case of longer damping tubes it is particularly advisable to provide a plurality of rows of radial bore holes in axial direction of the damping tube.

In order to guarantee a purely hydraulic centering in addition to the hydraulic damping of the step bearing sleeve, the damping gap should not be too large. As a result of tests, it has been established as favorable when the damping gap—with an average diameter of approximately 15 to 20 mm and a length of approximately 35 to 50 mm—has a gap width of from 0.2 mm to 0.4 mm.

In the case of variations from these dimensional recommendations, in particular in the case of a deviation from the gap width, the following disadvantages may occur:

In the case of the damping gap being too small, there is the risk that the shaft of the spindle deflects, that the damping is not sufficient and that the spindle hums during operation. In the case of the damping gap being too large, the shaft of the spindle makes excessively large oscillations, whereby the resetting force is reduced and the spindle operates unsteadily overall. A basic principle to be observed is that the smaller the average diameter is or the shorter the length of the damping gap is, the smaller the gap width must be.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
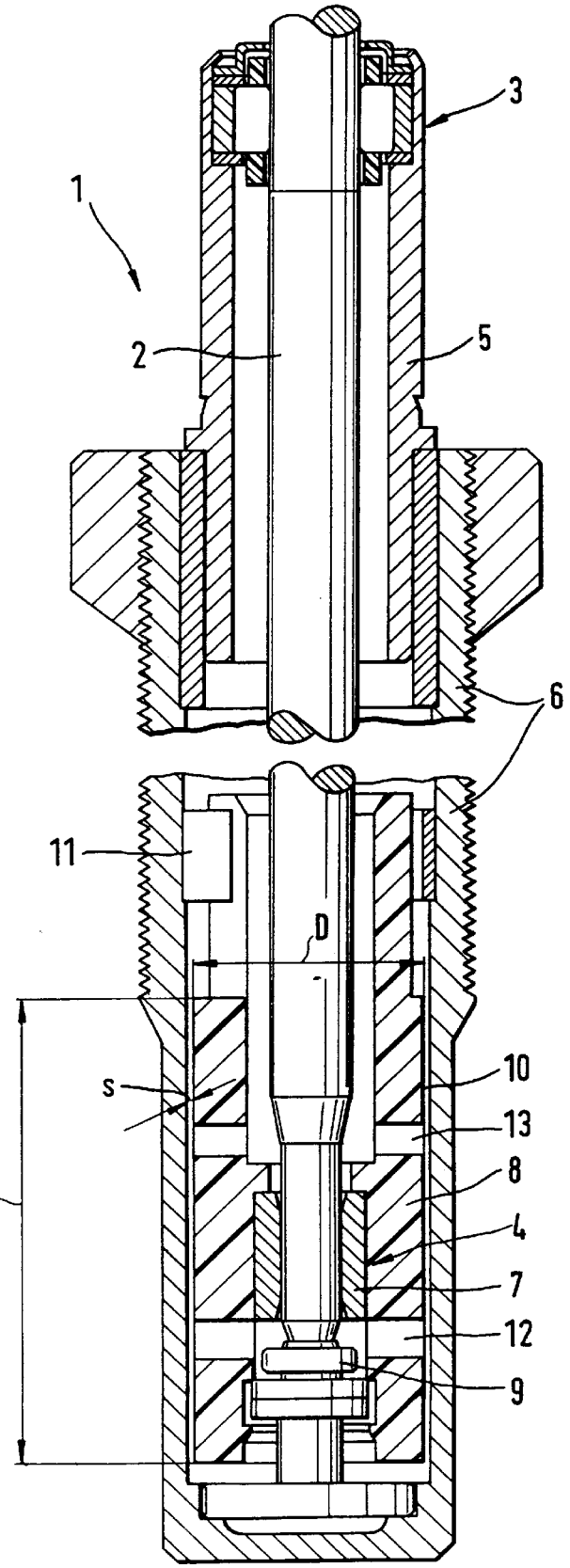
FIG. 1 is a longitudinal sectional view through a spindle in the form of a ring spindle, constructed according to a preferred embodiment of the present invention.

The spindle 1 shown in FIG. 1, which is suitable for a ring spinning machine or a ring twisting machine, comprises a shaft 2 which is driven to rotate in a way not shown here. The shaft 2 is supported in a neck bearing 3 and a step bearing 4. The neck bearing 3 is taken up in a tube-like neck bearing head 5, which is pressed into a bearing housing 6, if required with the aid of an intermediary fixing bush. The bearing housing 6 is closed underneath and so designed that it can be screwed onto a spindle rail (not shown) in a known way and vertically aligned.

The step bearing 4 comprises a step bearing sleeve 7, which serves to take up the radial forces. The step bearing sleeve 7 is supported in a radially movable and floatingly arranged damping tube 8, which is light and made of plastic.

The take up of the axial forces of the step bearing 4 is served by a thrust plate 9, on which the end of the shaft 2 is disposed. The thrust plate 9 itself is supported by means of a plurality of intermediary components on the bottom of the bearing housing 6.

Between the cylindrical outer contour of the damping tube 8 and the hollow cylindrical inner contour of the bearing housing 6 there is a narrow damping gap 10 which is filled with oil. The arrangement is so designed that the oil is also the lubricating oil in the area of the thrust plate 9 and the step bearing sleeve 7. With the exception of a torsion lock 11 in the form of a locking plate, the damping tube 8 is completely without contact with the bearing housing 6 and thus arranged in a free floating way.

The purpose of the damping gap 10 is to achieve a so-called gap damping, by means of which a hydraulic damping as well as a hydraulic centering of the shaft 2 is possible. In order to achieve this, the gap width s of the damping gap 10, the average diameter D as well as the length L of the damping gap 10 should fulfil certain geometrical requirements.

The gap width s depends among other things on the average diameter D and the length L of the damping gap 10. In the case of an average diameter D of approximately 15 to 20 mm and a length L of approximately 35 to 50 mm, a hydraulic damping as well as a purely hydraulic centering can be achieved with a gap width s in the range between 0.2 mm and 0.4 mm.

In the case of the gap width s of the damping gap 10 being smaller than 0.2 mm, there is a risk that the damping is not sufficient. If the gap width s is larger than 0.4 mm, there is on the other hand the risk that the shaft 2 makes excessively wide oscillations in the area of the step bearing 4 and that a purely hydraulic return motion of the step bearing sleeve 7 is no longer possible.

The damping tube 8 as shown in FIG. 1 is not subjected to bending load. It is far enough away from the neck bearing 3 and extends out over the step bearing 4.

The damping gap 10 is connected with the lubricating oil reserve in the area of the step bearing 4 by means of radial bore holes 12 and 13 of the damping tube 8. The radial bore holes 12 and 13 are spaced in axial direction of the damping tube 8, while in circumferential direction two or four radial bore holes 12 or 13 respectively are present.

The radial bore holes 12 and 13 ensure that in the damping gap 10 oil is constantly supplied to those points where, due to rotating wobbling movements of the damping tube 8, the oil tends to form gas bubbles. The rotating continual gap narrowing effects a vacuum, which results in localized evaporation of the oil. Thus the retarding forces acting on the step bearing sleeve 7 would no longer be sufficient. For this reason, sufficient amounts of oil are supplied from the area of the step bearing 4 to the critical points of the damping gap 10 by means of the radial bore holes 12 and 13.

Figure 2:
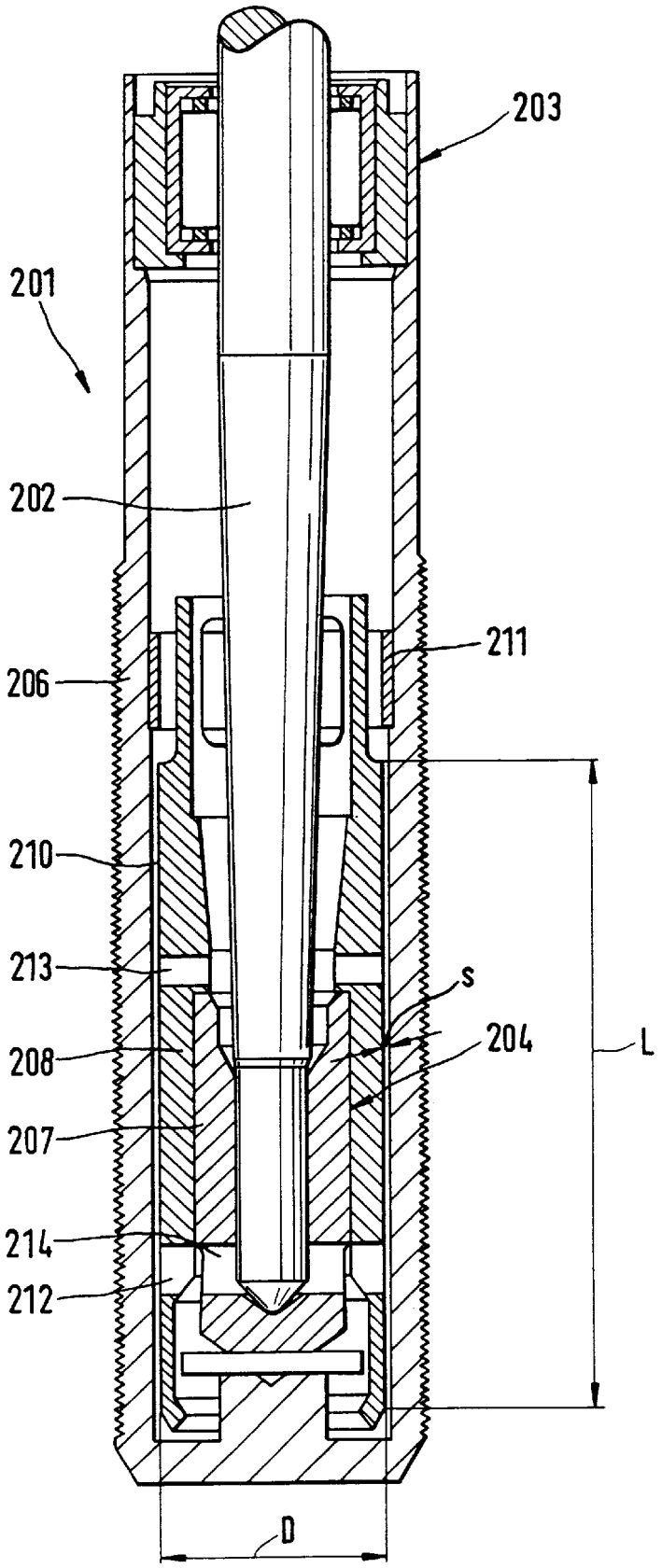
FIG. 2 is a longitudinal sectional view through a two-for-one spindle constructed according to another preferred embodiment of the present invention.

The spindle 201 shown in FIG. 2 is especially suited for two-for-one twist frames. The shaft 202 is rotatably supported in a neck bearing 203 and a step bearing 204. The neck bearing 203 is arranged directly in a bearing housing 206 without an intermediary neck bearing head.

The step bearing sleeve 207 is so designed that it can take up radial as well as axial forces. It serves thus also to support the end of the shaft 202 and is itself disposed by means of intermediary further components on the bottom of the bearing housing 206.

The step bearing sleeve 207 is taken up in a damping tube 208, which in the present invention advantageously takes the form of an aluminum extrusion part. Between the damping tube 208 and the bearing housing 206 is again disposed a ring-like narrow damping gap 210, which is filled with oil. This is the same oil which lubricates the step bearing 204. For this purpose, at least one transverse bore hole 214 is provided in the step bearing sleeve 207.

The damping tube 208, as in the embodiment in FIG. 1, is mounted in the bearing housing 206 only by means of a torsion lock 211, so that here too the damping tube 208 cannot transmit any bending load. The damping tube 208 in thus arranged free floating in the bearing housing 206. Hereby a purely hydraulic damping as well as a purely hydraulic centering acts on the step bearing sleeve 207.

The function of the gap damping and the hydraulic centering is in principle the same, as described with the aid of FIG. 1, whereby just the length L of the damping gap 210 is somewhat larger. The dimensional measurements remain overall identical, whereby in particular the gap width s lies in the range between 0.2 and 0.4 mm. The chosen tolerances of the damping gap 210 lie at around +/−0.05 mm.

As also in the case of the spindle 201 there is the risk that gas bubbles may form due to the gap narrowing rotating at spindle speed in the damping gap 210 and as a result of the arising localized vacuum, radial bore holes 212 and 213 are provided in the damping tube 208 also in this embodiment of the present invention. These radial bore holes 212 and 213 are located respectively in the lower and in the upper areas of the step bearing 204, that is, they are arranged at a certain distance in axial direction of the damping tube 208. In circumferential direction, two or four radial bore holes 212 or 213 are arranged. This permits oil to flow continuously from the area of the step bearing 204 into the damping gap 210, so that despite the risk of the formation of gas bubbles, the hydraulic centering of the step bearing sleeve 207 is constantly maintained.

Figure 3:
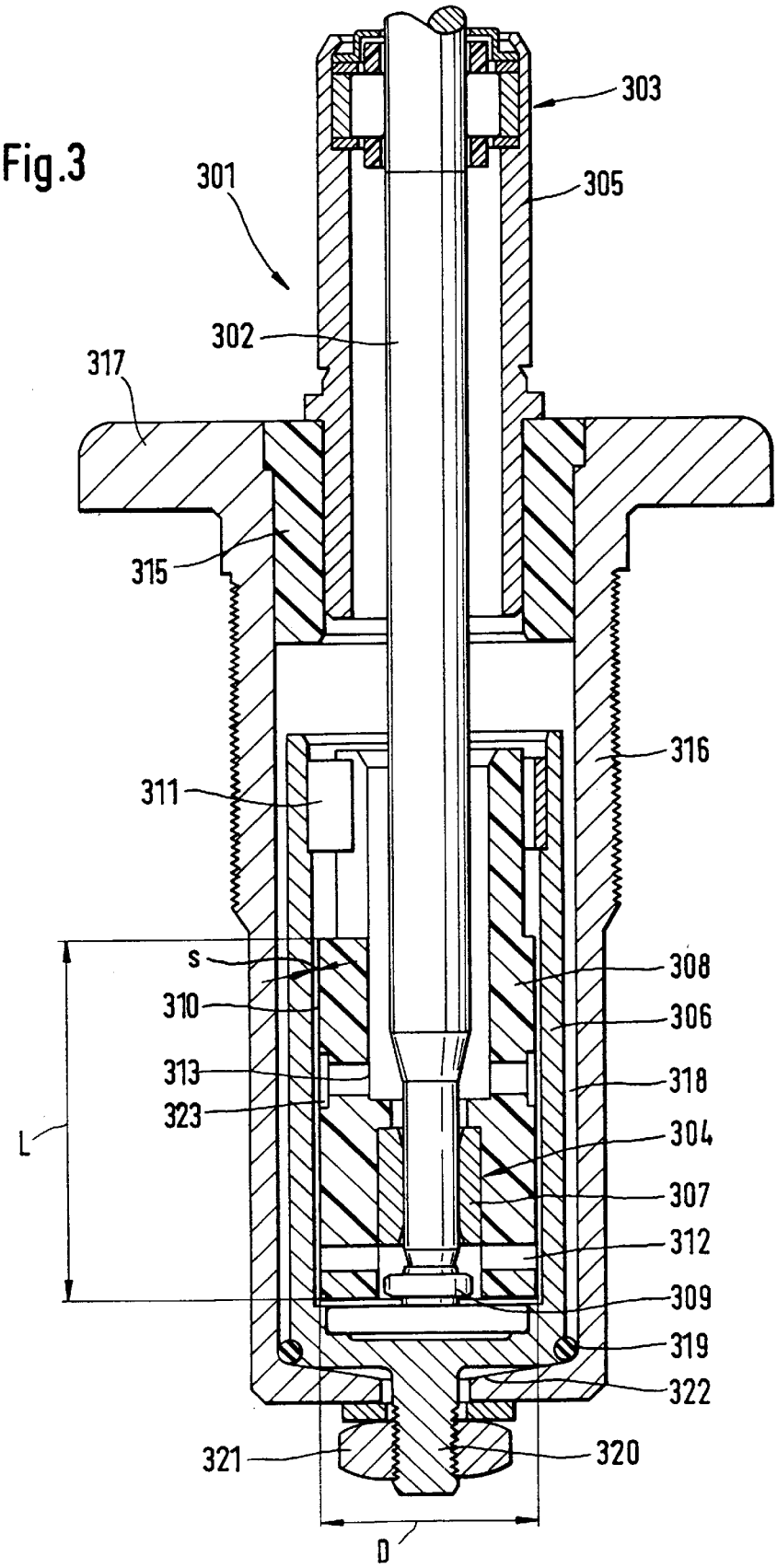
FIG. 3 is a longitudinal sectional view through a spindle in the form of an adjustable ring spindle constructed according to another preferred embodiment of the present invention.

The spindle 301 as shown in FIG. 3 is again provided for a ring spinning or ring twisting machine, whereby additional elements for adjusting the shaft 302 are present. The shaft 302 in this embodiment is also rotatably supported in a neck bearing 303 and in a step bearing 304.

The neck bearing 303 is taken up in a neck bearing head 305, which in turn is supported by means of a noise damping plastic insert tube 315 in a so-called outer housing 316.

The step bearing sleeve 307, which, as in the embodiment shown in FIG. 1, only takes up the radial forces, is supported in a damping tube 308. In order to take up the axial forces, the lower end of the shaft 302 is supported on a thrust plate 309, which in turn is disposed on a closed bottom of a bearing housing 306.

The bearing housing 306 is in the present case not much longer than the damping tube 308. A narrow ring-shaped damping gap 310 exists here also between the outer circumference of the damping tube 308 and the inner circumference of the bearing housing 306. The damping gap 310, together with the area of the step bearing 304, is filled with oil.

Apart from a torsion lock 311, the damping tube 308 is arranged free floating without any contact with the bearing housing 306. In addition to the hydraulic damping, the centering forces which act on the step bearing sleeve 307 are also purely hydraulically generated. The above mentioned outer housing 316 surrounds the bearing housing 306 with its inner contour and is extended to the area of the neck bearing head 305 in a way described above. The outer housing 316 comprises a radial flange 317, with the aid of which the outer housing 316 can be affixed to a spindle rail (not shown).

Between the outer contour of the bearing housing 306 and the hollow cylindrical inner contour of the outer housing 316 there is a second ring gap 318, which in contrast to the damping gap 310 is relatively large and filled with grease or viscose oil. The ring gap 318 serves primarily to block the transmission of noise outwards.

As the damping gap 310 and the second ring gap 318 are filled with different mediums, a sealing ring 319 is provided in the area of the bottom 322 of the outer housing 316, which sealing ring 319 provides a sealing between the outer housing 316 and the bearing housing 306. The bottom of the bearing housing 306 comprises an adjusting peg 320, which is guided out through a relatively large bore hole in the bottom of the outer housing 316. The bore hole is designed large enough so that the adjusting peg 320 can be adjusted in radial direction, so that the shaft 302, with respect to a spinning or twisting ring (not shown), can be centrically adjusted. The adjusted position is affixed by a fixing screw 321.

In order that the upper edge of the bearing housing 306 does not come into contact with the inner wall of the outer housing 316 during radial adjusting of the bearing housing 306 and thus also the shaft 302, care is taken that the additional second ring gap 318 cannot be bridged over by means of a crash stop in the upper area. For this reason, the bottom 322 of the outer housing 316 is dome-shaped or slightly conically formed, so that the bearing housing 306 disposed on the bottom 322 executes little swivel movements during adjustment, which do not narrow the additional second ring gap 318 in the upper area. This is then the case when the center of the swivel movement lies approximately at the upper end of the second ring gap 318.

The dimensions of the damping gap 310 with respect to its gap width s, its average diameter D and its length L correspond to those in the embodiments shown in FIG. 1 and 2. The gap width s is in particular to be set so that in addition to an effective hydraulic damping also a purely hydraulic centering is possible.

As in the embodiment shown in FIG. 3 there is again the risk that due to the localized vacuum occurring in the damping gap 310, gas bubbles arise, the damping tube 308 is provided just above and below the step bearing sleeve 307 with a plurality of radial bore holes 312 and 313. A plurality of radial bore holes 312 or 313 are distributed uniformly over the circumference. Thus oil can flow in sufficient quantities into the damping gap 310, so that the gas bubbles which form do not have a negative effect on the centering action of the spindle 301.

By means of the example of the radial bore holes 313 it is demonstrated that these may be additionally provided in the area of the damping gap 310 with oil pockets 323. These oil pockets 323, which could also be present in the embodiments according to FIGS. 1 and 2, serve the purpose of distributing the oil quicker in axial direction of the damping gap 310.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A spindle for spinning or twisting machines comprising:

a step bearing sleeve, a damping tube surrounding and supporting the step bearing sleeve, a bearing housing surrounding the damping tube, and an oil filled damping gap between the damping tube and the bearing housing, wherein the damping tube is arranged radially movable and only in contact with said step bearing.

2. A spindle according to claim 1, wherein a torsion lock is provided for preventing a gradual rotation of the damping tube during spinning operations.

3. A spindle according to claim 2, wherein the damping tube is made of plastic.

4. A spindle according to claim 3, wherein the damping gap, at an average diameter of the damping tube of approximately 15 to 20 mm and a length of approximately 35 to 50 mm, has a gap width of 0.2 to 0.4 mm.

5. A spindle according to claim 2, wherein the damping tube is provided with radial bore holes which connect the damping gap with the area of the step bearing sleeve.

6. A spindle according to claim 5, wherein the radial bore holes include a plurality of spaced radial bore holes provided at different axial positions of the damping tube.

7. A spindle according to claim 6, wherein the damping gap is extended to form oil pockets in the area of the radial bore holes.

8. A spindle according to claim 6, wherein the damping gap, at an average diameter of the damping tube of approximately 15 to 20 mm and a length of approximately 35 to 50 mm, has a gap width of 0.2 to 0.4 mm.

9. A spindle according to claim 5, wherein the damping gap is extended to form oil pockets in the area of the radial bore holes.

10. A spindle according to claim 9, wherein the damping gap, at an average diameter of the damping tube of approximately 15 to 20 mm and a length of approximately 35 to 50 mm, has a gap width of 0.2 to 0.4 mm.

11. A spindle according to claim 5, wherein the damping gap, at an average diameter of the damping tube of approximately 15 to 20 mm and a length of approximately 35 to 50 mm, has a gap width of 0.2 to 0.4 mm.

12. A spindle according to claim 2, wherein the damping gap, at an average diameter of the damping tube of approximately 15 to 20 mm and a length of approximately 35 to 50 mm, has a gap width of 0.2 to 0.4 mm.

13. A spindle according to claim 1, wherein the damping tube is made of plastic.

14. A spindle according to claim 13, wherein the damping gap, at an average diameter of the damping tube of approximately 15 to 20 mm and a length of approximately 35 to 50 mm, has a gap width of 0.2 to 0.4 mm.

15. A spindle according to claim 1, wherein the damping gap, at an average diameter of the damping tube of approximately 15 to 20 mm and a length of approximately 35 to 50 mm, has a gap width of 0.2 to 0.4 mm.

16. A spindle according to claim 1, wherein the spindle is a ring spinning spindle.

17. A spindle according to claim 1, wherein the spindle is a two-for-one spindle.

18. A spindle according to claim 17, wherein said damping tube is disposed in use axially above a bottom of said housing, said bottom of said housing being disposed to accept axial forces acting on said step bearing during spinning operations.

19. A spindle according to claim 1, comprising a thrust component disposed below the step bearing sleeve and serving to transmit spindle shaft axial forces to said bearing housing during spinning operations.

20. A spindle according to claim 19, wherein said thrust component is a thrust plate which is separate from the step bearing sleeve.

21. A spindle according to claim 19, wherein said thrust component is an integrally formed bottom part of the step bearing sleeve.

22. A spindle for spinning or twisting machines comprising:

a step bearing sleeve, a damping tube surrounding and supporting the step bearing sleeve, a bearing housing surrounding the damping tube, and an oil filled damping gap between the damping tube and the bearing housing, wherein the damping tube is arranged radially movable in the bearing housing and only in contact with said step bearing, and wherein the damping tube is provided with radial bore holes which connect the damping gap with the area of the step bearing sleeve.

23. A spindle according to claim 22, wherein the radial bore holes include a plurality of space radial bore holes provided at different axial positions of the damping tube.

24. A spindle according to claim 23, wherein the damping gap is extended to form oil pockets in the area of the radial bore holes.

25. A spindle according to claim 23, wherein the damping gap, at an average diameter of the damping tube of approximately 15 to 20 mm and a length of approximately 35 to 50 mm, has a gap width of 0.2 to 0.4 mm.

26. A spindle according to claim 22, wherein the damping gap is extended to form oil pockets in the area of the radial bore holes.

27. A spindle according to claim 26, wherein the damping gap, at an average diameter of the damping tube of approximately 15 to 20 mm and a length of approximately 35 to 50 mm, has a gap width of 0.2 to 0.4 mm.

28. A spindle according to claim 22, wherein the damping gap, at an average diameter of the damping tube of approximately 15 to 20 mm and a length of approximately 35 to 50 mm, has a gap width of 0.2 to 0.4 mm.

29. A spindle for spinning or twisting machines comprising:

a step bearing sleeve, a damping tube surrounding and supporting the step bearing sleeve, a bearing housing surrounding the damping tube, and an oil filled damping gap between the damping tube and the bearing housing, wherein the damping tube is arranged radially movable in the bearing housing, and wherein the damping gap, at an average diameter of the damping tube of approximately 15 to 20 mm and a length of approximately 35 to 50 mm, has a gap width of 0.2 to 0.4 mm.

30. A spindle according to claim 29, wherein a torsion lock is provided for preventing a gradual rotation of the damping tube during spinning operations.

31. A spindle according to claim 29, wherein the damping tube is made of plastic.

32. A spindle according to claim 29, wherein the damping tube is made of plastic.

* * * * *